US005351109A

United States Patent [19]

Haneda

[11] Patent Number: 5,351,109

[45] Date of Patent: Sep. 27, 1994

[54] MAGNETIC BRUSH FOR CHARGING AND CLEANING AN IMAGING SURFACE

[75] Inventor: Satoshi Haneda, Hachioji, Japan

[73] Assignee: Konica Corporation, Japan

[21] Appl. No.: 976,686

[22] Filed: Nov. 16, 1992

Related U.S. Application Data

[63] Continuation of Ser. No. 754,969, Sep. 4, 1991, abandoned.

[30] Foreign Application Priority Data

Sep. 7, 1990 [JP] Japan ..... 2-238478
Sep. 27, 1990 [JP] Japan ..... 2-258486

[51] Int. Cl.[5] ..... G03G 15/02; G03G 21/00
[52] U.S. Cl. ..... 355/219; 355/305; 361/225
[58] Field of Search ..... 355/219, 251, 305, 270, 355/303; 361/225; 430/125, 902

[56] References Cited

U.S. PATENT DOCUMENTS 4,174,903 11/1979 Snelling ..... 355/219
4,469,435 9/1984 Nosaki et al. ..... 355/303
4,545,669 10/1985 Hays et al. ..... 355/3 R

FOREIGN PATENT DOCUMENTS 272072 6/1988 European Pat. Off. .
459607 12/1991 European Pat. Off. .
59-133569 7/1984 Japan ..... 355/219
63-187267 8/1988 Japan ..... 355/219

OTHER PUBLICATIONS

Journal of Applied Physics 63(11) Jun. 1, 1988 pp. 5589–5593 Tetsutani, et al.; Photoreceptor . . . Printing Technology.

*Primary Examiner*—Joan H. Pendegrass
*Attorney, Agent, or Firm*—Jordan B. Bierman

[57] ABSTRACT

Apparatus for charging an imaging surface of a photoreceptor. The apparatus forms a magnetic brush on a cylinder spaced apart from and facing the photoreceptor by a magnet disposed in the cylinder. The cylinder and the magnet are rotatable relative to each other so that the magnetic brush moves around the cylinder and comes in contact with the imaging surface of the photoreceptor. An electric bias source is provided to apply an electric bias voltage having a DC voltage component and an AC voltage component between the imaging surface of the photoreceptor and the cylinder, whereby the imaging surface is charged by the magnetic brush under the electric bias voltage.

39 Claims, 5 Drawing Sheets

MAGNETIC BRUSH FOR CHARGING AND CLEANING AN IMAGING SURFACE

This application is a continuation of application Ser. No. 07/754,969, filed Sep. 4, 1991, now abandoned.

BACKGROUND OF THE INVENTION

The present invention relates to a charging device employing a magnetic brush which charges uniformly an image-forming object in an image forming apparatus such as an electrophotographic copying machine or the like.

Heretofore, there has generally been used a corona charging unit for charging an image-forming object such as a photoreceptor drum or the like in an image forming apparatus of an electrophotographic type. In the corona charging unit, high voltage is applied to a discharge wire around which a strong electric field is formed to cause gaseous discharge, and charged ions produced by the gaseous discharge are adsorbed on the image-forming object, thus the image-forming object is charged.

Such conventional corona charging unit employed in an image forming apparatus has an advantage that an image-forming object is not damaged when it is charged because it can be charged without touching mechanically the corona charging unit. However, the corona charging unit is disadvantageous in that there is a risk of electric shock and electric leakage due to high voltage used therein, and ozone produced in gaseous discharge is harmful for the human body and shortens life of the image-forming object. Further, the charged voltage produced by the corona charging unit is unstable because it is highly affected by temperature and humidity, and the corona charging unit requires some time to obtain a stable charging voltage after initial inputting of high voltage, which are serious problems when an image forming apparatus of an electrophotographic type is used as a communication terminal or an information processor.

Many disadvantages of a corona charging method mentioned above are caused by gaseous discharge accompanying the charging.

In this connection, as a charging device capable of charging an image-forming object without requiring gaseous discharge as in the corona charging unit and without giving mechanical damage to the image-forming object, there is disclosed a charging device in Japanese Patent Publication Open to Public Inspection No. 133569/1984 (hereinafter referred to as Japanese Patent O.P.I. Publication) wherein a magnetic brush formed by adherence of magnetic particles on a cylinder holding therein a magnet can brush, for charging, the surface of an image-forming object.

However, even in the case of the charging device disclosed in the aforementioned Japanese Patent O.P.I. Publication No. 133569/1984, it has been impossible to charge an image-forming object uniformly with perfect stability.

SUMMARY OF THE INVENTION

The first object of the invention is to solve the aforementioned problems and to provide a charging device capable of charging uniformly with perfect stability while producing only a minimum amount of ozone.

The aforementioned first object of the invention can be attained by a charging device consisted of a cylinder which is rotatable around magnets having magnetic poles outside and a magnetic brush composed of magnetic particles adhering to the cylinder surface. The cylinder is moved, for charging an image-forming object, in the direction identical with or opposite to the moving direction of the image-forming object so that the magnetic brush to which a bias voltage is applied may brush the image-forming object, wherein the voltage to be impressed on the aforementioned magnetic brush has a DC component and an AC bias component.

The second object of the invention is to provide a charging and cleaning device wherein minimum ozone is produced, stable and uniform charging is achieved and an image-forming object can be cleaned.

The aforementioned second object can be attained by a charging and cleaning device having therein a cylinder which can rotate around a magnetic roll having magnetic poles outside and a magnetic brush composed of magnetic particles adhering to the cylindrical surface. The cylinder is rotated, to removing untransferred toner remaining on an image-forming object and for charging the aforementioned image-forming object, in the different peripheral speed from that of the image-forming object so that the magnetic brush with bias voltage applied may brush the surface of the image-forming object, wherein the aforementioned bias voltage has a DC component and an AC component.

DETAILED DESCRIPTION OF THE PREFERRED EMBODIMENT

Figure 1:
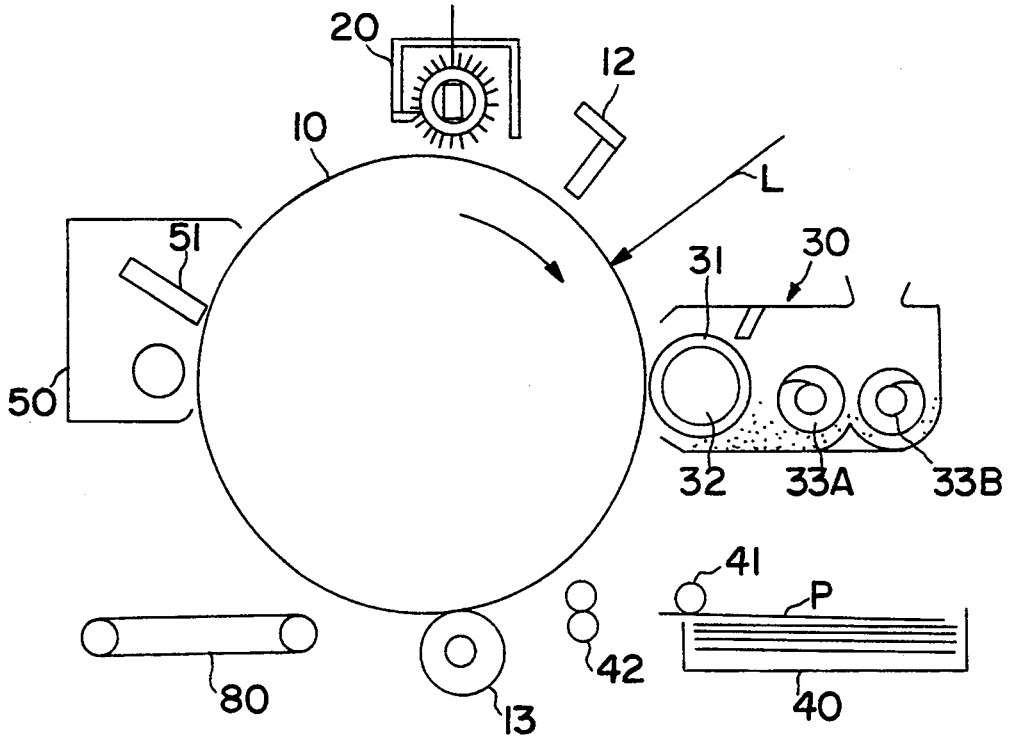
FIG. 1 is a sectional view showing schematic constitution of an electrostatic recording apparatus equipped with a charging device that attains the first object of the invention.

With regard to the particle size of magnetic particles used for the invention, when an average particle size of magnetic particles is large, a magnetic brush generally tends to be uneven, resulting in uneven charging, even when charging while giving vibration by means of an AC electric field, because the magnetic brush formed on a brush carrier is coarse. For solving this problem, it is effective to reduce the average particle size of the magnetic carrier particles, and experiments have shown that an effect of reducing the average particle size appears when the average particle size is reduced to 100 μm or less, and the problem of the uneven charging does not occur substantially when the average particle size is 70 μm or less. However, when particles are too small, the particles tend to adhere to the surface of an image carrier and to scatter during charging. These phenomena are related to the intensity of a magnetic field acting on particles and the magnetization of particles, and they generally appear clearly when the average particle size of particles is 30 μm or less.

From the foregoing, the average particle size of 100 μm or less is preferable and that ranging from 70 μm to 30 μm is more preferable. Incidentally, the magnetization of 20–200 emu/g is preferable.

For the aforementioned magnetic particles, the particles of ferromagnetic materials such as iron, chromium, nickel and cobalt; compounds thereof; alloys such as, for example, tri-iron tetroxide, γ-ferric oxide, chromium dioxide, manganese oxide, ferrite and manganese-copper; the aforementioned magnetic particles covered with styrene, vinyl, ethylene, denatured rosin, acrylic, polyamide, epoxy and polyester resins, or the like; or particles made of binder resins and fine magnetic particles dispersed therein; especially after particle size classification by conventional methods; can be used successfully.

Incidentally, magnetic particles which are sphere shaped provide an advantage that a particle brush formed on a brush carrier can be made uniform and high voltage can be applied to the brush carrier. Sphere-shaped magnetic particles make magnetization of each particle isotropic; thereby the magnetic brush is formed uniformly, thus preventing unevenness of bristle length and electrical resistance. The sphere-shaped magnetic particles are also desirable because they minimize electric field concentration at the tip of magnetic brush. These advantages are especially apparent when the electrical resistance of the magnetic particles is above a certain value, thus preventing a large current discharging even when electric field concentration does exist. As a sphere particle providing the aforementioned effect, it is preferable that magnetic particles are formed so that electrical resistivity of the magnetic particles thereof be $10^5$ Ω·cm or more, and especially not more than $10^{12}$ Ω·cm. This electrical resistivity corresponds to the value obtained by reading a current value after putting particles in a container having a sectional area of 0.5 $cm^2$ and tapping, applying a load of 1 $kg/cm^2$ on the stuffed particles, and applying voltage between the load and an electrode on the bottom of the containing for generating an electric field of 1000 V/cm. When the electrical resistivity of the magnetic particles is low, an electric charge is transferred to the magnetic particles and they thereby tend to stick to the surface of the image carrier, or breakdown of the bias voltage tends to occur. When the electrical resistivity is too high, the electric charge does not enter a magnetic particle and thereby no charging is carried out.

In a summary of the foregoing, it is an optimum condition that a magnetic particle is formed to be a sphere whose ratio of the major axis and the minor axis is 3 or less, the particle has no protrusion such as a needle-shaped portion or an edge, and an electrical resistivity is not less than $10^5$ Ω·cm, preferably not less than $10^5$ Ω·cm and not more than $10^2$ Ω·cm. Therefore, the ferromagnetic particles should be as spheric as possible. Also useful are magnetic particles of binder resin with fine magnetic particles dispersed therein, which are manufactured by a bonding process after conventional particle size classification or through a spray-dry process of the component materials.

The foregoing represents conditions for magnetic particles. Next, the conditions for a magnetic particle carrier on which a particle layer is formed and an image carrier is charged will be explained. The magnetic particle carrier should be such that the bias voltage can be applied thereto. In particular, the carrier is preferably used with a sleeve inside which a magnetic body, having a plurality of magnetic poles, is arranged, so that the particle brush is formed on the surface of the sleeve.

In the case of the particle carrier mentioned above, a particle brush formed on the surface of the sleeve moves while undulating like a wave. Therefore, fresh magnetic particles are supplied in succession, and the unevenness in thickness of the brush can be leveled fully by the aforementioned wave undulation so that no problem will be caused in practical use, even when there is unevenness in the thickness of the particle brush on the surface of the sleeve. It is preferable that the speed of the magnetic particles carried by the rotation of the sleeve, and/or by the rotation of the magnetic body is approximately the same as or higher than the speed of the image carrier. Further, the direction of carrying particles by rotation of the sleeve and/or the magnetic body may be either the same or opposite. When considering the cleaning efficiency, however, the opposite direction is better than the same direction. However, the invention is not limited to the foregoing.

Further, it is desirable that the particle brush formed on the brush carrier be scraped off sufficiently by a regulating plate so that the thickness of the brush is uniform; it is also desirable that the clearance between the brush carrier and the image carrier is 100–5,000 μm. When the clearance between the particle carrier and the image carrier is smaller than 100 μm, it becomes difficult to form bristles of a magnetic brush that can uniformly charge the surface of the image carrier, and it becomes impossible to supply sufficient magnetic particles to the charging zone; thus, stable charging cannot be carried out. When the clearance exceeds 5000 μm, on the other hand, a particle layer is formed coarsely and uneven charging tends to take place, and further, efficiency of transfer of electric charge to the particles is reduced, thus sufficient charging cannot be carried out. As stated above, when the clearance between the brush carrier and the image carrier is extremely small or extremely large, it becomes impossible to adjust the thickness of the particle brush on the particle carrier for such clearance. However, when the thickness is in the range of 100–5000 μm, it is possible to adjust the thickness of the particle brush properly therefor, and this results in preventing brush marks due to brushing by the magnetic brush.

As the second object of the invention, residual toner particles adhering to the image carrier after development are removed by brushing of the magnetic brush, and the magnetic brush device in the present invention is suitable for a regular image forming apparatus wherein normal development is conducted. For example, in an image forming apparatus wherein an image carrier is charged positively, normal development is carried out with toner charged negatively. Therefore, when the magnetic particles which charge toner negatively are used, toner particles being brushed off will adhere to the magnetic particles of the magnetic brush; thus, the toner particles are removed from the image carrier.

When toner particles are introduced into the charging magnetic brush, the resistance of the magnetic brush is increased, resulting in a reduction of charging efficiency. Therefore, the magnetic brush which has finished charging the image carrier is caused to contact a collection roller impressed with a positive DC voltage higher than the charging voltage; thus it is possible to collect the toner on the magnetic brush by the collection roller.

The invention also includes a cleaning device which is suitable for a reversal image forming apparatus wherein reversal development is conducted. For example, in an image forming apparatus wherein an image carrier is charged positively, reversal development is conducted with toners charged positively. Therefore, when magnetic particles which charge the toner positively are used, the toner particles adhere to magnetic particles of the magnetic brush while they are brushing; thus toner particles are collected from the image carrier. In this case, voltage to be applied to the magnetic brush is the same as that on the toner particles in terms of polarity. Therefore, even if some of toner particles adhere to the photoreceptor as an image carrier, it does not affect image formation because the polarity of the toner particles remains unchanged. However, when toner particles are brought into the charging magnetic brush, the resistance of the magnetic brush is increased, resulting in the reduction of charging efficiency. Therefore, the magnetic brush, which has fully charged the image carrier, is caused to contact the collection roller impressed with positive or negative DC voltage lower than the charging voltage; thus the collecting roller can remove the toner particles on the magnetic brush and transfer them to the collecting roller.

FIG. 1 is a sectional view showing schematic constitution of an electrophotographic recording apparatus equipped with a charging device that achieves the first object of the invention.

In the figure, the numeral 10 is a photoreceptor drum that is an image forming object rotating in the arrowed direction, and it is surrounded by charging unit 20, neutralizing unit 12, image-wise exposure L from an exposure unit, developing unit 30, transfer roller 13 and cleaning unit 50, all of which will be explained later.

In the basic operation for copying process in the present example, when a command for the start of copying is sent from an unillustrated operation unit to an unillustrated control unit, the photoreceptor drum 10 starts rotating in the arrowed direction due to the control by the control unit. When the photoreceptor drum 10 rotates, its circumferential surface is charged uniformly by the charging unit 20 which will be explained later, and passes through the neutralizing unit 12. The neutralizing unit 12, due to the control of the aforementioned control unit, neutralizes the charge at the marginal area outside the image area by illumination with an LED, for example. However, in the reversal development which will be described later, the neutralizing unit 12 is not needed. On the photoreceptor drum 10, image writing is conducted, for example, by a scanning exposure unit that scans an unillustrated document or by an image writing unit by means of laser beam L, thus electrostatic latent images corresponding to the image of document are formed.

The developing unit 30 contains therein two-component developer which is stirred by stirring screws 33A and 33B and then adheres on the external surface of developing sleeve 31 that rotates outside magnet roller 32 for forming a magnetic brush of developers. On the developing sleeve 31, predetermined bias voltage is applied and development is conducted in the developing area. In this case, when an ordinary scanning optical system is used for forming a latent image, regular development is carried out, while when image-wise exposure by means of a laser beam is conducted, reversal development is usually conducted. The electrostatic latent image on the photoreceptor drum 10 is developed by the developing unit 30 to become a visible toner image.

From the sheet feed cassette 40, recording sheet P is fed out one sheet by one sheet by the first sheet feed roller 41. The recording sheet P thus fed out is sent onto the photoreceptor drum 10 by the second sheet feed roller 42 that operates synchronously with the aforementioned toner image on the photoreceptor drum 10. The toner image on the photoreceptor drum 10 is transferred onto the recording sheet P by an action of transfer roller 13, and then the recording sheet is separated from the photoreceptor drum 10. The recording sheet P on which the toner image has been transferred is sent to an unillustrated fixing unit through transport means 80, and then is sandwiched between a heat fixing roller and a pressure roller so that the toner image may be melted and fixed on the recording sheet. After that, the recording sheet is ejected from the apparatus. The surface of the photoreceptor drum 10 that rotates while holding thereon residual toner particles which have not been transferred onto recording sheet P are scraped off by cleaning unit 50 equipped with blade 51 for the next copying cycle.

Figure 2:
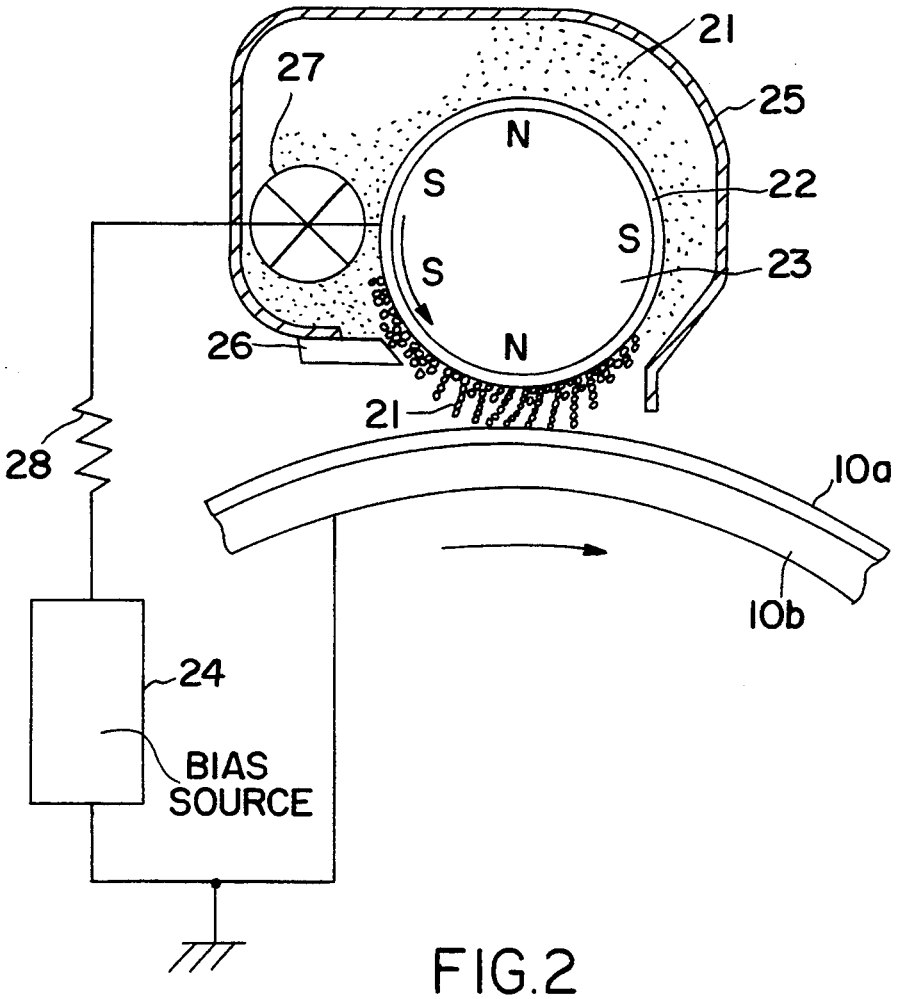
FIG. 2 is a sectional view showing an example of a charging device of the invention.

FIG. 2 is a sectional view showing an example of charging device 20 of the invention to be used for the electrostatic recording apparatus shown in FIG. 1. In the figure, the numeral 21 represents magnetic particles which are spherical ferrite particles coated to be conductive. As an alternative, it is possible to use conductive magnetic resin particles which are obtained through thermal kneading of magnetic powder and resin and pulverizing thereof. For better charging, each of the particles is adjusted so that its external shape is spherical; it has an average particle size of 50 $\mu$m and a specific resistance of $10^8$ $\Omega$·cm.

The numeral 22 is a conductive cylinder made of non-magnetic metal, 23 is a column-shaped magnet bar (roll) arranged inside the conductive cylinder 22. The magnet bar 23 shown in the figure is magnetized to have an S-poles and an N-poles outside, and conductive cylinder 22 is supported to rotate around fixed magnet bar 23. Further, magnet bar 23 has an equally spaced magnetic poles which may also rotate. Conductive cylinder 22 is rotated so that its peripheral speed is desirably 1.2 to 2.0 times faster than that of the photoreceptor drum 10 and the direction of the movement of the conductive cylinder where it faces drum 10 is the same as that of photoreceptor drum 10.

The photoreceptor 10 is composed of conductive base material **10*b* and photoreceptor material 10*a* which covers the conductive base material 10*b*, and the conductive material 10*b*** is grounded.

The numeral 24 is a power source for bias voltage which applies bias voltage between the aforementioned conductive cylinder 22 and the conductive base material **10*b*, and the conductive cylinder 22 is grounded through the power source for bias voltage 24 and a protective resister 28**.

The aforementioned power source for bias voltage 24 supplies the bias voltage on which an AC component is superimposed on the DC component at a voltage approximately equal to the voltage to be charged. The value of the bias voltage depends on the clearance between the conductive cylinder 22 and the photoreceptor drum 10, and on the surface voltage to be applied to the photoreceptor, when its clearance is kept in the range of 0.1–5 mm. Preferable charging conditions use a bias voltage in which the AC component of 200–3500 V was superimposed, as Peak- Peak voltage ($V_{p-p}$), on the DC component of 500–1000 V, which is substantially the same as the voltage to be charged.

Incidentally, in the power source for bias voltage 24, DC component is controlled on the constant-voltage control basis and AC component is controlled on the constant-current control basis.

The numeral 25 is a casing which forms a storage portion for the aforementioned magnetic particles 21, and the aforementioned conductive cylinder 22 and magnet bar 23 are arranged in this casing 25. On the outlet of the casing 25, there is provided regulating plate 26 which regulates the thickness of the layer of magnetic particles 21 which adhere to the conductive cylinder 22 and are carried by it, thus the gap between the photoreceptor drum 10 and the conductive cylinder 22 is filled with magnetic particles 21 having the desired thickness.

Next, operation of the aforementioned charging device 20 will be explained.

When the conductive cylinder 22 is rotated in the arrowed direction at a peripheral speed 1.2–2.0 times that of photoreceptor drum 10 while the drum is rotated in the arrowed direction, magnetic particles 21 adhering to the conductive cylinder 22 and carried thereby and connected magnetically to each other to form a brush on conductive cylinder 22 where it faces photoreceptor drum 10, due to the magnetic force of magnet bar 23; thus a magnetic brush is formed. The magnetic brush is conveyed in the rotating direction of the conductive cylinder 22 and touches and brushes the photoreceptor layer 10a of the photoreceptor drum 10. Since the aforementioned bias voltage is applied between the conductive cylinder 22 and the photoreceptor drum 10, electric charges are injected into the photoreceptor layer 10a through conductive magnetic particles 21, thus charging is effected. In this case, due to the application of the AC bias voltage, vibration contributes to charge injection from the magnetic brush onto the photoreceptor, resulting in extremely stable and uniform charging. Stirring plate 27 is a rotating object having, around its shaft, plate-shaped members which correct deviation of magnetic particles 21. Incidentally, FIG. 3 shows the results obtained by changing the frequency and voltage of the AC component of the voltage impressed on cylinder 2.

Figure 3:
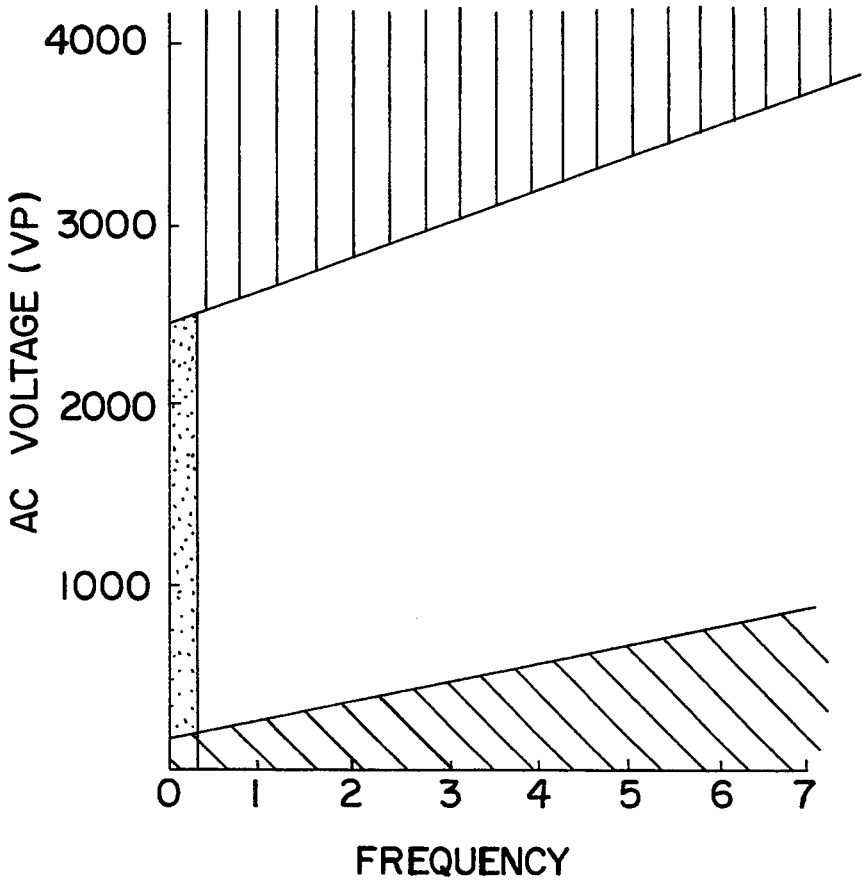
FIG. 3 is a charging diagram obtained by changing frequency and voltage of AC voltage component.

In FIG. 3, a vertically-hatched zone is the area where dielectric breakdown tends to occur, the obliquely-hatched zone is the area where uneven charging tends to occur, and the unhatched zone is the desirable area where stable charging can be carried out. As is clear from FIG. 3, the desirable range of the AC voltage component changes slightly depending on the frequency of the AC voltage component. With regard to the waveform of AC voltage component, a square wave or a chopping wave may be used, the invention not being limited to a sine wave. Further, the low frequency zone shaded with fine dots is an area in which uneven charging takes place because of the low frequency.

For obtaining non-charging in the present example, it is enough to cause the DC component in the bias voltage to be zero. Further, bristles of the magnetic brush are laid down by a horizontal magnetic field to be parallel to the direction of a tangent at a point facing the photoreceptor drum 10 and thereby the magnetic particles contact photoreceptor drum 10; thus, it is possible to provide the state of non-charging.

Incidentally, when a large amount of toner particles remains on the surface of photoreceptor drum 10 without being cleaned due to the operation of the apparatus for a long time, they may enter into the layer of magnetic brush 21, and the resistance of the magnetic brush is thereby increased and charging efficiency deteriorates. Therefore, this should be prevented. For this purpose, it is possible to design magnetic particles so that they obtain sufficient charge by frictional electrification with toners and it is possible to provide, in the charging device 20, a collection roller to be impressed with a voltage for generating an electric field which attracts toner particles to cause such toners to adhere thereto by the electric field and thus be collected. When the polarity of DC bias voltage to be impressed on the conductive cylinder 22 is the same as that of charged toner, the toner particles tend to adhere to the photoreceptor; thus, it is possible to prevent the toners from entering the layer of magnetic particles. Especially when the charging polarity of the photoreceptor drum 10 is the same as that of the toners as in the case of an image forming apparatus conducting reversal development, the charging polarity of the charges on the surface of photoreceptor 10 is the same as that of the toners in the developing unit; thus, no fogging appears on images in the course of developing, resulting in a preferred form of the invention.

To remove the entered toners when a bias voltage with an AC component having a polarity opposite to that of photoreceptor 10, is applied between conductive cylinder 22 and photoreceptor drum 10, the particles of the toner and dust adhering to magnetic particles 21 or in casing 25 move toward photoreceptor drum 10 and adhere thereto. In this case, since bias voltage is an AC bias voltage, it is possible to cause the particles of toner and dust to move from magnetic particles 21 to photoreceptor drum 10 efficiently and adhere thereto; thus it is possible to remove these particles in magnetic particles 21.

With regard to timing for removing the adhering substances, it is possible to remove them during non-image-forming period, such as, for example, the warm-up period of the image forming apparatus. Alternatively, this can be done by releasing the adhered substances to a non-image-forming portion between two successive images to be accumulated there during image formation; thus, image quality does not deteriorate even in the case of a plurality of successive image formations.

When no image-forming is effected, the power source control means controls the power source for bias voltage 24 so that it may supply the bias voltage wherein the AC component is superimposed on a DC component having a polarity opposite to that of the aforesaid charging. That is, when an AC bias voltage, wherein the AC component at 200 V–3500 V as peak-to-peak voltage and DC voltage at −100 V−−1000 V, are applied, toner particles adhering to magnetic particles 21 move to the photoreceptor drum 10 and adhere thereto. Furthermore, DC component only may be impressed unlike the case in the present example wherein AC component is superimposed on DC component. However, it is possible to remove particles of toner and dust adhering to magnetic particles 21 more efficiently if AC component is also superimposed.

In any event, charging means 20 can be refreshed to recover its charging efficiency when substances accumulated on magnetic particles 21 are caused to adhere to the photoreceptor drum 10 to be removed collectively by cleaning means 50. Thus, it is possible not only to charge stably at all times but also to keep the surface of the photoreceptor drum 10 clean constantly. Therefore, it is possible to form images stably at all times without deteriorating image quality of toner images to be formed.

The present invention can provide a charging device wherein the applied voltage can be reduced because the electric charges can be injected directly onto the photoreceptor drum, formation of ozone can be prevented, and extremely stable and uniform charging can be achieved due to the superimposed AC bias voltage.

Figure 4:
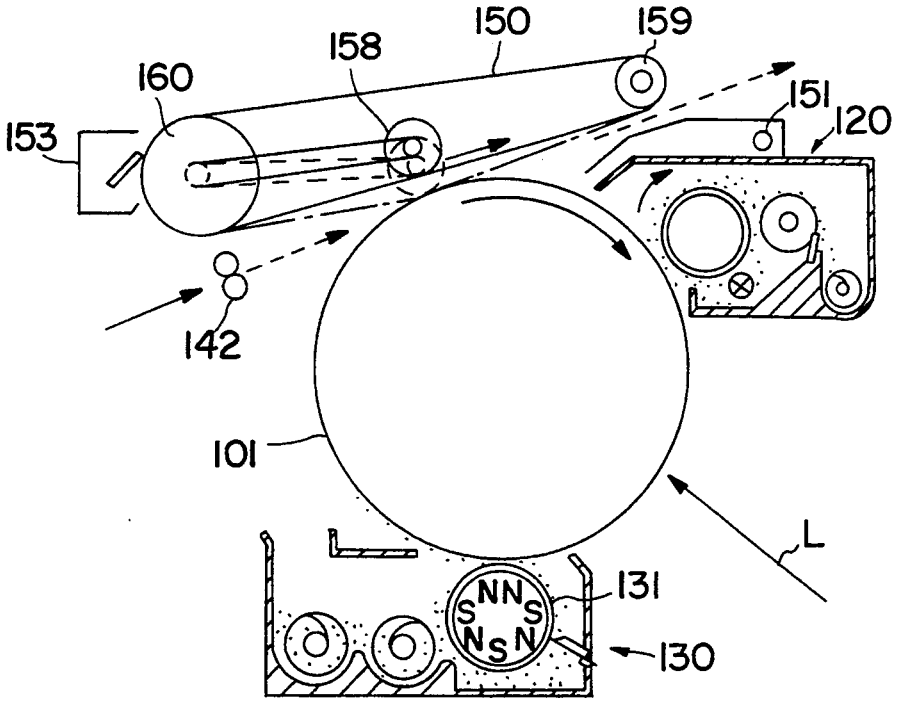
FIG. 4 is a sectional view showing schematic constitution of an image forming apparatus provided with a charging and cleaning device which attains the second object of the invention.

An example achieving the second object of the invention will be explained as follows. FIG. 4 is a sectional view showing the schematic constitution of an image forming apparatus equipped with a charging unit and a cleaning unit both of the present invention.

In the figure, the numeral 101 is a drum-shaped photoreceptor that is an image forming object which rotates in the arrowed direction (clockwise), and it is surrounded by charging and cleaning unit 120, developing unit 130, and transfer belt 150.

Figure 7:
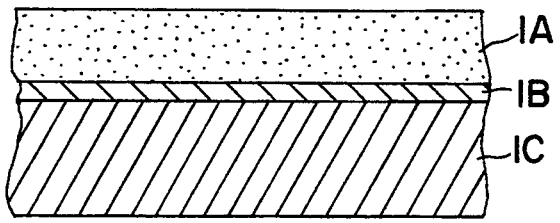
FIG. 7 is a sectional view showing an example of constitution of the high gamma photoreceptor.

The photoreceptor 101 is a high-$\gamma$ type photoreceptor composed of photosensitive layer 1A, interlayer 1B and conductive support 1C as shown in FIG. 7. The thickness of the photosensitive layer is 5–100 $\mu$m and preferably is 10–50 $\mu$m. In the photoreceptor 101, there is used drum-shaped conductive support 1C made of aluminum having thereon interlayer 1B that is made from ethylene-vinylacetate copolymer and has thickness of 0.1 $\mu$m on which photosensitive layer 1A having layer thickness of 35 $\mu$m is provided.

As the conductive support 1C, a drum made of aluminum, steel or copper is suitable. Alternatively, a belt-shaped support wherein a metallic layer is laminated or evaporated onto a paper plastic film, or a metallic belt, such as a nickel belt prepared by electroforming, may be used. On the other hand, it is preferable that the interlayer is such that it permits the photoreceptor to withstand such high voltages of 1500 to 200 V and, in the case of positive charging, has a positive hole-conducting property so that electrons are prevented from entering the layer from conductive support 1C and thereby, the photoreceptor will have excellent photodecay characteristics due to the avalanche phenomenon. It is therefore preferable that charge transport substances of the positively charging type, described in Japanese Patent O.P.I Publication No. 188975/1986, are added to interlayer 1B in an amount of not more than 10% by weight.

As the interlayer 1B, it is generally possible to use the following resins, for example, used in a photosensitive layer for electrophotography.

(1) Vinyl type polymer such as polyvinyl alcohol (poval)
(2) Nitrogen-containing vinyl polymer such as polyvinylamine
(3) Polyether type polymer such as polyethyleneoxide
(4) Acrylic acid type polymer such as polyacrylic acid and its salt
(5) Methacrylic acid polymer such as polymethacrylic acid and its salt
(6) Cellulose ether type polymer such as methylcellulose
(7) Polyethyleneimine type polymer such as polyethyleneimine
(8) Polyamino acid such as polyalanine
(9) Starch and its derivative such as starch acetate and amine starch
(10) Polymer soluble in a mixed solvent of water and alcohol, such soluble nylon as polyamide The photosensitive layer 1A is formed by applying to the interlayer a coating suspension prepared by mixing and dispersing photoconductive phthalocyanine fine pigment particles having a particle size of 0.1–1 $\mu$m and an antioxidant in a binder resin solution without adding any charge transport material, drying and, when necessary, heat-treating.

When using a photoconductive material and a charge transport substance in combination, a photoconductive substance comprising a photoconductive pigment and a charge transport substance in an amount which is not more than one fifth of the photoconductive pigment by weight, preferably one thousandth to one tenth of the photoconductive pigment by weight, and an antioxidant are dispersed in binder resin to make the photosensitive layer 1A.

When a part of a toner image not transferred after reversal development remains on the photoreceptor 101 even after cleaning and charging in accordance with the invention, a photoreceptor having its spectral sensitivity in the long wavelength region and an infrared-ray transmitting toner are necessary so that a beam from a scanning optical system is not shielded by the toner images.

Figure 6:
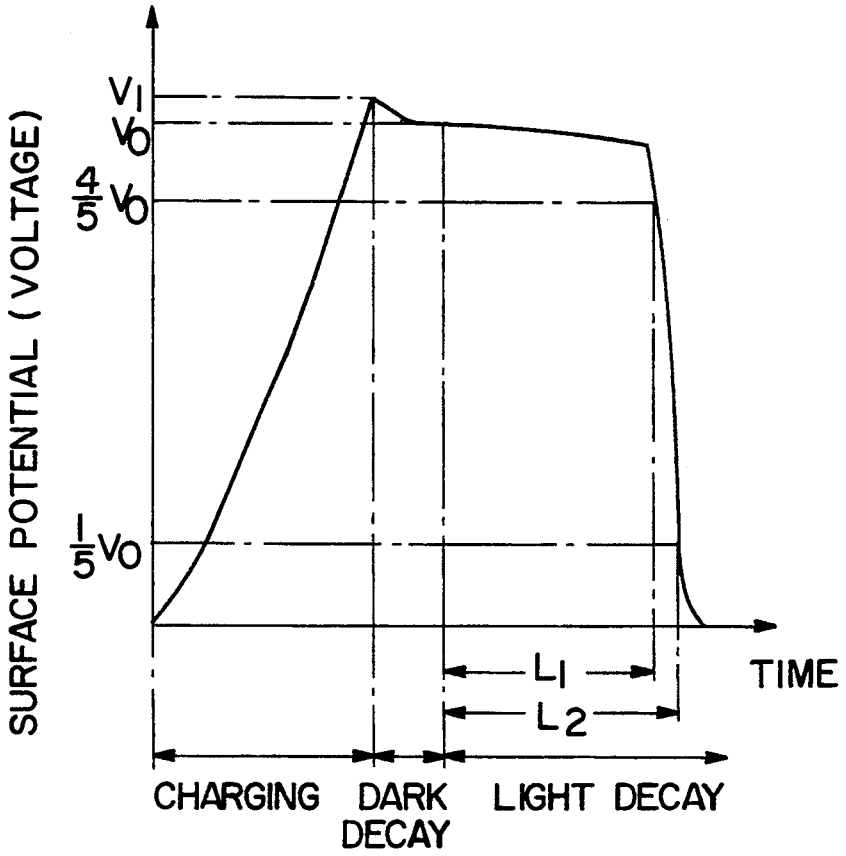
FIG. 6 is a graph showing characteristics of a high gamma photoreceptor.

Light-decay characteristics of a high $\gamma$ type photoreceptor in the present example will be explained as follows. FIG. 6 is a graph showing characteristics of a high-$\gamma$ type photoreceptor.

In the figure, $V_1$ is charged voltage (V), $V_0$ is initial voltage (V) just before exposure, $L_1$ is the energy amount ($\mu J/cm^2$) of illuminating light of a laser beam that is needed for the surface potential to decay to 4/5 thereof, and $L_2$ is an energy amount ($\mu J/cm^2$) of illuminating light of a laser beam that is needed for the surface potential to decay from the initial voltage to 1/5 thereof.

The preferable range of $L_2/L_1$ is as follows.

$$1.0 \leqq L_2/L_1 \leqq 1.5$$

The present example has the following conditions.

$$V_1 = 1000\ V,\ V_0 = 950\ V,\ L_2/L_1 = 1.2, \text{ and}$$

the photoreceptor surface voltage in the exposed area is 10 V.

There is selected a photoconductive semiconductor which satisfies the relation $$(E_{\frac{1}{2}})/(E_{9/10}) \geqq 2$$

preferably of $$(E_{\frac{1}{2}})/(E_{9/10}) \geqq 5,$$

wherein, $E_{\frac{1}{2}}$ is photosensitivity at the position corresponding to the middle period of exposure where the surface potential has decayed to a half of initial voltage Vo thereof in a light decay characteristic curve, and $E_{9/10}$ is the photosensitivity at the position corresponding to the initial period of exposure where the surface potential has decayed to 9/10 of initial voltage Vo. In these cases, the photosensitivity is defined in terms of the absolute value of voltage decay by extremely small quantities of light.

In the light decay curve of the present photoreceptor, the absolute value of a differential coefficient for voltage-decay characteristics having the photosensitivity shown in FIG. 6 is small in the case of small quantities of light exposure, and it decays sharply as the quantities of light exposure increase. To be concrete, the light decay curve shows, in the initial period of exposure, a flat curve for a certain period $L_1$ representing poor sensitivity characteristics as shown in FIG. 6 but, in the middle period of exposure ranging from $L_1$ to $L_2$, the light decay curve changes suddenly to an ultra-high $\gamma$ portion that falls linearly showing ultra-high sensitivity. It is considered that the photoreceptor actually shows high $\gamma$ characteristics by an avalanche phenomenon under high potentials of +500–+2000 V. It is concluded that carriers generated on the surface of a photoconductive pigment in the initial period of exposure are trapped effectively in the boundary layer between the photoconductive pigment particle matrix and the resin, thereby inhibiting light decay. This results in an extremely sudden avalanche phenomenon when exceeding a certain amount of exposure. The photoreceptor of this kind has a special feature in that the uneven charging and insufficient cleaning of the photoreceptor does not affect the image quality because recording is carried out on a binary basis. In the basic operation of copy process in the present example, when a copy start command is sent from an unillustrated operation unit to an unillustrated control unit, the photoreceptor 101 starts rotating in the arrowed direction, being controlled by the control unit. When the photoreceptor 101 rotates, the peripheral surface thereof is cleaned and charged uniformly by charging and cleaning unit 120. On the photoreceptor 101, image writing is conducted by means of laser beam L, for example, from an unillustrated image writing device, thus, electrostatic latent image corresponding to the original image is formed on the photoreceptor 101.

DC bias voltage, or AC bias voltage wherein the AC component is superimposed on the DC component, is applied to developing sleeve 131 of developing unit 130; thereafter, non-contact development with a two-component developer is carried out to form the toner image. In this case, either contact development by means of two-component developer or contact or non-contact development by means of mono-component developer may be used.

Toner images thus formed on the photoreceptor 101 are transferred onto an image receiving sheet which is sent one by one by the first sheet feed roller from an unillustrated sheet feed cassette and successively sent by the second sheet feed roller 142 synchronizing with the aforementioned toner images, to be moved in the arrowed direction. The toner image mentioned above is transferred on an image receiving sheet sent onto a transfer belt 150 which is caused to start running before the transfer to make the image receiving sheet contact the photoreceptor.

The aforesaid transfer belt 150 is spread between roller 159 and roller 160 and is rotated by the roller 160 to synchronize with photoreceptor 101, and it is separated from or contacted by the photoreceptor 101, depending on the upward movement or downward movement of bias roller 158, respectively.

For the aforementioned transfer belt 150, a conductive cloth-padded rubber belt is used as a basic support, and a high resistivity layer or an insulator layer made of an elastic material having the thickness of 0.5 mm is provided on the external surface of the cloth-padded rubber belt.

The aforementioned transfer is conducted by bias roller 158 when a transfer voltage, whose polarity is opposite to that of the toner, is impressed on bias roller 158. Incidentally, toner particles adhering to transfer belt 150 are removed and cleaned by cleaning unit 153.

The image receiving sheet, onto which the toner image has been transferred in the aforesaid manner, is separated from the peripheral surface of the photoreceptor 101 and then is ejected by a sheet delivery roller after being transported to fixing unit (not shown) wherein the toner image on the image receiving sheet is fused and fixed to its surface.

On the other hand, photoreceptor 101, after the image receiving sheet has been separated, is neutralized by neutralizing lamp 151 and then cleaned by charging and cleaning unit 120 which removes residual toner particles remaining on photoreceptor 101, so that it is ready for the following print cycle.

Figure 5:
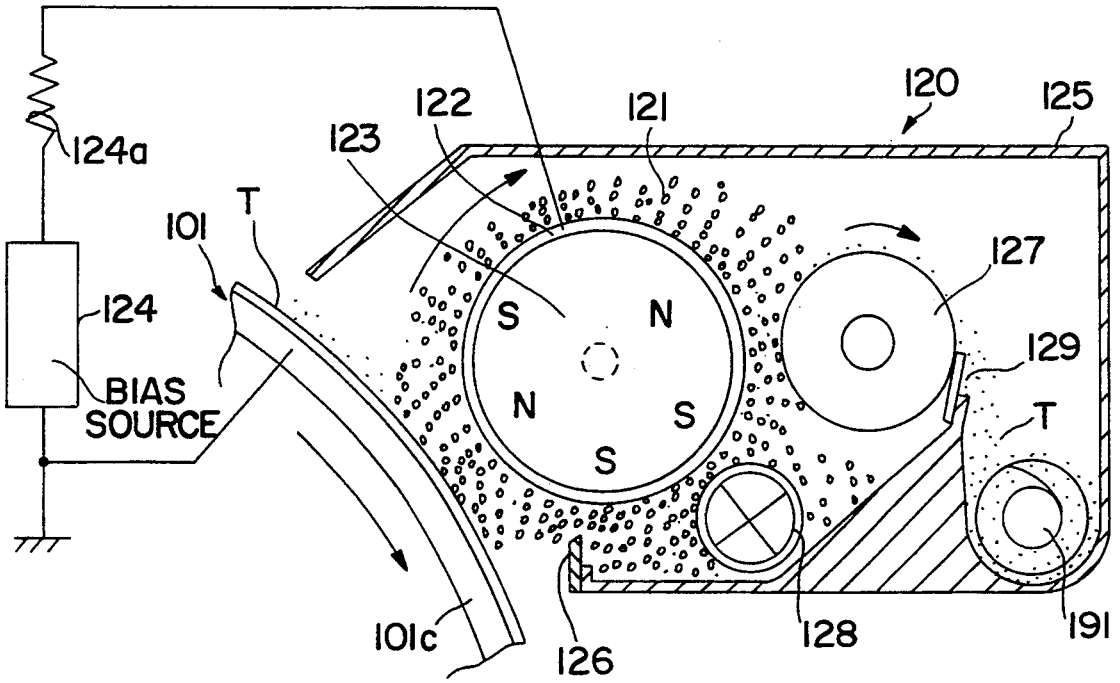
FIG. 5 is a sectional view showing an example of a charging and cleaning device of the invention.

FIG. 5 is a sectional view showing an example of charging and cleaning unit 120 of the invention used for the electrostatic recording apparatus in FIG. 4. In the figure, 121 is the magnetic particles and, in this embodiment, spherical ferrite particles coated with conductive resin were used. For excellent charging, the particles are spherical and have an average particle size of 50 $\mu$m and a specific resistivity of $10^8$ $\Omega$·cm. As an alternative, conductive magnetic resin particles obtained by pulverizing a mixture of magnetic particles and a resin binder as the principal ingredient, after thermal kneading thereof, may also be used.

The numeral 122 is a conductive cylinder made of non-magnetic metal and the numeral 123 is a bar-shaped magnet bar (roll) arranged inside the conductive cylinder 122. The magnet 123 is magnetized to have therein an S-pole and an N-pole, and the conductive cylinder 122 is supported rotatably about fixed magnet 123. Magnet 123 may also rotate and may have its poles equally spaced from one another. The magnetic force of magnet 123 is not less than 600 gauss, and the aforementioned magnetic particles 121 are magnetized to 50 emu/g. Further, conductive cylinder 122 is rotated in the direction opposite to the moving direction of the photoreceptor 101 at the point where the conductive cylinder faces to the photoreceptor 101 at a peripheral speed which is 1.2–2.0 times that of photoreceptor 101.

The conductive support 101C of the photoreceptor 101 is grounded.

The numeral 124 is a power source for bias voltage that applies bias voltage between the aforementioned conductive cylinder 122 and conductive support 101C, and the conductive cylinder 122 is grounded through this power source for bias voltage 124.

The aforementioned power source for bias voltage 124 is a power source that supplies the bias voltage wherein AC component is superimposed on a DC component having about the same voltage as that to which the photoreceptor is charged. The voltage is applied through protective resistor 124*a*. The conditions for impression of voltage depend upon the distance between the conductive cylinder 122 and the photoreceptor 101 and upon the charging voltage on photoreceptor 101. Preferred conditions are the bias voltage having an AC component of 200–3500 V as peak-to-peak voltage superimposed on a DC component of 500–1000 V.

The latter is substantially the same as the charging voltage to be applied, and the clearance is in the range of 0.1–5 mm. To avoid uneven charging, the frequency of the AC component is preferably 300 Hz–10 kHz.

Incidentally, in the power source for bias voltage 124, constant-voltage control is applied to DC component and constant-current control is applied to AC component.

The numeral 125 is a casing that forms a storage area for the aforementioned magnetic particles 121, and the aforementioned conductive cylinder 122 and magnet 123 are located in the casing 125. At the outlet of the casing 125, there is provided regulating plate 126 which regulates the height of magnetic particles 121 which adhere to conductive cylinder 122 and are conveyed thereby so that the height of particles matches the established clearance for development; thus, the clearance between photoreceptor 101 and conductive cylinder 122 is filled with magnetic particles 121 regulated in terms of their height. Numeral 127 is a toner-collecting roller which is impressed with a bias voltage whose polarity is opposite that on charged toner T, and stirring plate 128 rotates a plate-shaped member around a shaft which corrects unevenness in the pile of magnetic particles 121 on cylinder 122. Numeral 129 is a toner-collecting blade that scrapes off collected toner T from collecting roller 127, and toner-collecting screw 191 conveys collected toner T to a collecting box or to developing unit 130. In this example, the results obtained by changing frequency and voltage of the AC voltage component of the bias voltage impressed on conductive cylinder 122 are the same as those shown in FIG. 3.

Next, the operation of charging and cleaning unit 120 will be explained.

When conductive cylinder 122 is rotated in the arrowed direction, which is opposite to the rotation of the photoreceptor, at a peripheral speed 1.2–2.0 times that of photoreceptor 101, magnetic particles 121 are magnetically connected to each other by lines of magnetic force of magnet 123 to form a magnetic brush at the position on conductive cylinder 122 where it faces photoreceptor 101. The magnetic brush is conveyed in the rotating direction of conductive cylinder 122 and brushes photosensitive layer 101A of photoreceptor 101 to catch any toner T remaining untransferred on photosensitive layer 101A. Since the aforementioned AC bias voltage is applied between conductive cylinder 122 and photoreceptor 101, electric charges are injected into photosensitive layer 101A through conductive magnetic particles 121; thus, charging is carried out. Since the AC bias voltage is specifically employed as the bias voltage in this case, it is possible to conduct the charging which is extremely stable. In this situation, toner T remaining untransferred on photoreceptor 101 adheres electrostatically to the aforementioned magnetic brush which brushes the photosensitive layer and it is conveyed to collecting roller 127. Thereafter, toner T is transferred to collecting roller 127 by the higher bias voltage applied thereto. Toner particles moved to collecting roller 127 are scraped off by collecting blade 129 and drop to the bottom of casing 125 where they are conveyed by collecting screw 191 to the collecting box (not shown), or conveyed to developing unit 130 as recycled toner.

When magnetic particles 121 located at the tip of the magnetic brush arrive at stirring plate 128, they are scraped off thereby and stirred; thus magnetic particles 121 of the magnetic brush are replaced constantly. Further, toner T mixed with magnetic particles 121 is collected immediately as stated above. Therefore, increase in the resistivity of magnetic particles 121 and the resulting loss in charging efficiency is avoided, resulting in consistently stable and uniform charging.

Furthermore, when the photoreceptor 101 having a specific high $\gamma$ is used as described in the example represented by FIG. 4 and further toner T, which is transparent to infrared rays of wavelength not shorter than 750 nm (disclosed in Japanese Patent Application No. 92660/1989) is used, no problem occurs even if a certain amount of toner T remains provided that the toner particles do not concentrate at one location. Therefore, the magnetic brush in the present example shows an excellent cleaning effect and, even when toner T is not collected perfectly, the magnetic brush is an excellent cleaning means because it has a leveling effect on toner T. Toner T is transparent to the infrared rays in the case of forming reversal images using reversal development. For a non-charging operation, as in the present example, the DC component of the bias voltage should be zero. Further, when the direction of poles N - S of magnet 123 is changed to be in parallel with a tangent at the point where the magnet faces the photoreceptor 101, bristles of the magnetic brush are caused by a horizontal magnetic field to be in parallel with a tangent at the point where the magnet faces the photoreceptor 101, thus the magnetic brush can be separated from the photoreceptor to create the state of non-charging and non-cleaning.

Assuming a case where two-component development and positive charging of the photoreceptor are carried out, for example;

(a) the toner has to be charged negatively for normal development, wherein a developer whose carrier charges the toner negatively through frictional electrification, is used and (b) for reversal development, the toner has to be charged positively, and a developer whose carrier charges the toner positively is used.

Further, if the same magnetic particles are used in the developer carrier, the toner collection also can be carried out effectively; this makes this process a superior charging and cleaning means.

Another advantage of the invention is the ability to lower the charging voltage and thereby minimize the generation of ozone because the electric charges are applied directly onto the photoreceptor. The presence of the AC bias component prevents deterioration of the photoreceptor and provides uniform charging. Therefore, the present invention provides a combined charging and cleaning unit which allows an image forming apparatus to be small in size.

I claim:

1. An apparatus for charging an imaging surface of an image carrying member comprising a rotatable cylinder;

a magnet in said cylinder member;

a magnetic brush comprising spherical magnetic particles formed on said cylinder by a magnetic field generated by said magnet, and a bias for applying a bias voltage to said magnetic brush, said bias voltage comprising a DC voltage component and an AC voltage component.

2. The apparatus of claim 1 wherein an electrical resistivity of said magnetic particles is from $10^5$ to $10^{12}$ $\Omega$cm.

3. The apparatus of claim 1 wherein a clearance between said cylinder member and said image carrying member is from 0.1 to 5 mm.

4. The apparatus of claim 1 wherein a peak-to-peak value of said bias voltage is 200 to 3500 V.

5. The apparatus of claim 1 wherein magnetization of said magnetic particles is 20 to 200 emu/g.

6. A method of charging an imaging surface of an image carrying member comprising:

forming a magnetic field on a brush carrying member;

forming a magnetic brush comprising spherical magnetic particles by said magnetic field on said brush carrying member;

bringing said magnetic brush into contact with said imaging surface of said image carrying member;

moving said magnetic particles of said magnetic brush; and applying a bias voltage to said magnetic brush, said bias voltage comprising a DC voltage component and an AC voltage component.

7. The method of claim 6 wherein an electrical resistivity of said magnetic particles is from $10^5$ to $10^{12}$ Ωcm.

8. The method of claim 6 wherein a clearance between said brush carrying member and said image carrying member is from 0.1 to 5 mm.

9. The method of claim 6 wherein a peak-to-peak value of said bias voltage is from 200 to 3500 V.

10. The method of claim 6 wherein a magnetization of said magnetic particles is from 20 to 200 emu/g.

11. A method of charging an image surface of an image carrying member, comprising the steps of:

forming magnetic field on a brush carrying member;

forming a magnetic brush composed of magnetic particles having an electrical resistivity of $10^5$ to $10^{12}$ Ωcm by said magnetic field on said brush carrying member;

bringing said magnetic brush in contact with said imaging surface of said image carrying member;

moving said magnetic particles composing said magnetic brush; and applying a bias voltage to said magnetic brush, said bias voltage comprising a DC voltage component and an AC voltage component.

12. The method of claim 11 wherein the clearance between said brush carrying member and said image carrying member is within the range of 0.1 to 5 mm.

13. The method of claim 11 wherein the magnetization of said magnetic particles is within the range of 20 to 200 emu/g.

14. An apparatus for charging an image surface of an image carrying member comprising:

a rotatable cylinder;

a magnet in said cylinder;

a magnetic brush comprising magnetic particles and formed on said cylinder by a magnetic field generated by said magnet;

a bias for applying a bias voltage to said magnetic brush, said bias voltage comprising a DC voltage component and an AC voltage component; and a device for controlling said bias voltage to reduce said DC voltage component of said bias voltage in order that said imaging surface not be charged.

15. An image forming apparatus comprising:

an image forming element comprising toner particles on an imaging surface of an image carrying member;

a charger for charging said imaging surface of said image carrying member;

said charging member comprising;

a rotatable cylinder;

a magnet in said cylinder;

a magnetic brush composed of magnetic particles and formed on said cylinder by magnetic field generated by said magnet member; and a bias for applying a bias voltage to said magnetic brush, said bias voltage comprising a DC voltage component and an AC voltage component;

wherein said toner particles are charged through frictional electrification with said magnetic particles.

16. The apparatus of claim 15 further comprising a collecting roller for collecting said toner particles, which are conveyed to said charger.

17. The apparatus of claim 15 wherein said toner particles which are conveyed to said charger are transferred to said imaging surface.

18. The apparatus of claim 15 wherein a polarity of said DC voltage component is the same as frictional electrification polarity of said toner particles.

19. An image forming apparatus comprising:

an image forming element comprising toner particles on an imaging surface of an image carrying member;

a charger for charging said imaging surface of said image carrying member and cleaning said imaging surface;

said charger comprising:

a rotatable cylinder;

a magnet in said cylinder;

a magnetic brush comprising magnetic particles and formed on said cylinder member by a magnetic field generated by said magnet member; and a bias for applying a bias voltage to said magnetic brush, said bias voltage comprising a DC voltage component and an AC voltage component;

wherein said toner particles are charged through frictional electrification with said magnetic particles.

20. The apparatus of claim 19 further comprising a collecting roller for collecting said toner particles, which are conveyed to said charger.

21. The apparatus of claim 19 wherein said toner particles which are conveyed to said charging means are transferred to said imaging surface.

22. The apparatus of claim 19 wherein a polarity of said DC voltage component is the same as the frictional electrification polarity of said toner particles.

23. A method of charging an imaging surface of an image carrying member comprising;

forming a magnetic field on a brush carrying member;

forming a magnetic brush composed of magnetic particles by said magnetic field on said brush carrying member;

bringing said magnetic brush into contact with said imaging surface of said image carrying member;

moving said magnetic particles of said magnetic brush; and applying a bias voltage to said magnetic brush, said bias voltage comprising a DC voltage component and an AC voltage component;

wherein a peak-to-peak value of said bias voltage is from 200 to 3500 V; and wherein an electrical resistivity of said magnetic particles is from $10^5$ to $10^{12}$ Ωcm.

24. A method of charging an imaging surface of an image carrying member comprising;

forming a magnetic field on a brush carrying member;
forming a magnetic brush composed of magnetic particles by said magnetic field on said brush carrying member;
bringing said magnetic brush into contact with said imaging surface of said image carrying member;
moving said magnetic particles of said magnetic brush; and
applying a bias voltage to said magnetic brush, said bias voltage comprising a DC voltage component and an AC voltage component;
wherein a peak-to-peak value of said bias voltage is from 200 to 3500 V; and
wherein a clearance between said brush carrying member and said image carrying member is within the range of 0.1 to 5 mm.

25. A method of charging an imaging surface of an image carrying member comprising;
forming a magnetic field on a brush carrying member;
forming a magnetic brush composed of magnetic particles by said magnetic field on said brush carrying member;
bringing said magnetic brush into contact with said imaging surface of said image carrying member;
moving said magnetic particles of said magnetic brush; and
applying a bias voltage to said magnetic brush, said bias voltage comprising a DC voltage component and an AC voltage component;
wherein a peak-to-peak value of said bias voltage is from 200 to 3500 V; and
wherein the magnetization of said magnetic particles is within the range of 20 to 200 emu/G.

26. An apparatus for charging an imaging surface of an image carrying member comprising
a rotatable cylinder;
a magnet having N and S poles in said cylinder;
a magnetic brush comprising magnetic particles and formed on said cylinder by magnetic field generated by said magnet;
a bias for applying a bias voltage to said magnetic brush, said bias voltage comprising a DC voltage component and an AC voltage component;
moving said poles so as to cause said magnetic field to be substantially parallel to said imaging surface whereby said magnetic brush comes out of contact with said imaging surface and said imaging surface is not charged.

27. An apparatus for charging an imaging surface of an image carrying member, comprising:
a rotatable cylinder;
a magnet in said cylinder;
a magnetic brush composed of magnetic particles formed on said cylinder by a magnetic field of said magnet, wherein an electrical resistivity of said magnetic particles is $10^5$ to $10^{12}$ Ωcm; and
an applicator for applying a bias voltage to said magnetic brush, said bias voltage comprising a DC voltage component and an AC voltage component;
wherein a peak-to-peak value of said AC voltage in said bias voltage is 200 to 3500 V.

28. An apparatus for charging an imaging surface of an image carrying member, comprising:
a rotatable cylinder, wherein clearance between said cylinder and said image carrying member is 0.1 to 5 mm;
a magnet disposed in said cylinder;
a magnetic brush composed of magnetic particles formed on said cylinder by a magnetic field of said magnet; and
an applicator for applying a bias voltage to said magnetic brush, said bias voltage comprising a DC voltage component and an AC voltage component;
wherein a peak-to-peak value of said AC voltage in said bias voltage is 200 to 3500 V.

29. An apparatus for charging an imaging surface of an image carrying member, comprising:
a rotatable cylinder;
a magnet disposed in said cylinder;
a magnetic brush composed of magnetic particles formed on said cylinder by a magnetic field of said magnet member, wherein magnetization of said magnetic particles is 20 to 200 emu/g; and
an applicator for applying a bias voltage to said magnetic brush, said bias voltage comprising a DC voltage component and an AC voltage component;
wherein a peak-to-peak value of said AC voltage in said bias voltage is 200 to 3500 v.

30. An apparatus for charging an imaging surface of an image carrying member, comprising:
a rotatable cylinder;
a magnet disposed in said cylinder;
a magnetic brush composed of magnetic particles having an electrical resistivity of $10^5$ to $10^{12}$ Ωcm formed on said cylinder member by a magnetic field of said magnet; and
an applicator for applying a bias voltage to said magnetic brush, said bias voltage comprising a DC voltage component and an AC voltage component.

31. The apparatus of claim 30 wherein a clearance between said cylinder and said image carrying member is 0.1 to 5 mm.

32. The apparatus of claim 30 wherein magnetization of said magnetic particles is 20 to 200 emu/g.

33. An apparatus for charging an image surface of an image carrying member comprising:
a rotatable cylinder;
a magnet in said cylinder;
a magnetic brush composed of spherical magnetic particles having an average particle size of 30 to 100 μm and formed on said cylinder by a magnetic field generated by said magnet; and
a bias for applying a bias voltage to said magnetic brush, said bias voltage comprising a DC voltage component and an AC voltage component.

34. An apparatus for charging an image surface of an image carrying member comprising:
a rotatable cylinder;
a magnet in said cylinder;
a magnetic brush composed of magnetic particles having an average particle size of 30 to 100 μm and, having an electrical resistivity of $10^5$ to $10^{12}$ Ωcentimeters, formed on said cylinder by a magnetic field generated by said magnet; and
a bias for applying a bias voltage to said magnetic brush, said bias voltage comprising a DC voltage component and an AC voltage component.

35. An apparatus for charging an image surface of an image carrying member comprising:
a rotatable cylinder;
a magnet in said cylinder;
a magnetic brush composed of spherical magnetic particles having an average particle size of 30 to 100 μm and formed on said cylinder by a magnetic field generated by said magnet; and a bias for applying a bias voltage to said magnetic brush, said bias voltage comprising a DC voltage component and an AC voltage component;

a clearance between said cylinder and said image copying member is 0.1 to 5 mm.

36. A method of charging an image surface of an image carrying member comprising:

forming a magnetic field on a brush carrying member;

forming a magnetic brush composed of spherical magnetic particles having an average particle size of 30 to 100 μm by said magnetic field on said brush carrying member;

bringing said magnetic brush into contact with said imaging surface of said image carrying member;

moving said magnetic particles composing said magnetic brush; and applying a bias voltage to said magnetic brush, said bias voltage comprising a DC voltage component and an AC voltage component.

37. A method of charging an image surface of an image carrying member comprising:

forming a magnetic field on a brush carrying member;

forming a magnetic brush composed of magnetic particles having an average particle size of 30 to 100 μm by said magnetic field on said brush carrying member, said magnetic particles having an electrical resistivity of $10^5$ to $10^{12}$ Ωcentimeters;

bringing said magnetic brush into contact with said imaging surface of said image carrying member;

moving said magnetic particles composing said magnetic brush; and applying a bias voltage to said magnetic brush, said bias voltage comprising a DC voltage component and an AC voltage component.

38. A method of charging an image surface of an image carrying member comprising:

forming a magnetic field on a brush carrying member;

forming a magnetic brush composed of magnetic particles having an average particle size of 30 to 100 μm by said magnetic field on said brush carrying member;

bringing said magnetic brush into contact with said imaging surface of said image carrying member;

moving said magnetic particles composing said magnetic brush; and applying a bias voltage to said magnetic brush, said bias voltage comprising a DC voltage component and an AC voltage component;

a clearance between said brush carrying member and said image carrying member is 0.1 to 5 mm.

39. A method of charging an image surface of an image carrying member comprising:

forming a magnetic field on a brush carrying member;

forming a magnetic brush composed of spherical magnetic particles having an average particle size of 30 to 100 μm by said magnetic field on said brush carrying member, a magnetization of said magnetic particles being 20 to 200 emu/g;

bringing said magnetic brush into contact with said imaging surface of said image carrying member;

moving said magnetic particles composing said magnetic brush; and applying a bias voltage to said magnetic brush, said bias voltage comprising a DC voltage component and an AC voltage component.

* * * * *